United States Patent [19]

Stier

[11] 4,092,756

[45] June 6, 1978

[54] DIVER'S BUOYANT CADDY

[76] Inventor: Barry Robert Stier, P.O. Box 102, Ginowan, Okinawa, Japan

[21] Appl. No.: 787,987

[22] Filed: Apr. 15, 1977

[51] Int. Cl.[2] ..... B63B 21/52

[52] U.S. Cl. ..... 9/8 R; 9/14; 114/54; 114/244

[58] Field of Search ..... 9/8 R, 14, 9; 114/244, 114/245, 52, 53, 54, 16 E, 16.5; 61/69, 70

[56] References Cited

U.S. PATENT DOCUMENTS

| | | | |
|---|---|---|---|
| 2,163,795 | 12/1936 | Merralls | 9/8 R |
| 2,635,574 | 4/1953 | Sturtevant | 114/54 |
| 3,512,493 | 4/1968 | Hallanger | 9/8 R |
| 3,543,526 | 5/1968 | O'Neill et al. | 9/8 R |
| 3,732,837 | 5/1973 | Hogan | 9/8 R |

*Primary Examiner*—Stephen G. Kunin
*Assistant Examiner*—Stuart M. Goldstein
*Attorney, Agent, or Firm*—J. Gibson Semmes

[57] ABSTRACT

Diver's Caddy Vessel, adapted primarily to move beneath a seaway surface, made buoyant by the diver's exhalant into a skirt of the vessel, whereby to offset suspension weight of diver's gear, game and the like, characterized by a collapsible, bladder-like enclosure which is elongate in exterior configuration, open at the bottom, the bottom being defined by a dependent skirt and having a stringer interiorally thereof. The caddy stringer is adapted to the detachable engagement of a restraint line to the diver and/or stringer extensions for gear and game, the vessel further including a connector at one end for towing on a seaway surface.

1 Claim, 3 Drawing Figures

DIVER'S BUOYANT CADDY

BACKGROUND OF THE INVENTION AND DESCRIPTION OF THE PRIOR ART

As will be more apparent from the ensuing description, the present diver's buoyant caddy is an immersible vessel which is adapted to accompany the scuba diver on his rounds underwater. Not only is it capable of moving under the surface of the sea during the diver's rounds but it is also floatable to ride on the surface of the sea, as in towing.

The known art is best illustrated by French Pat. No. 2,142,218 dated January 1973 and the U.S. Pat. No. to Merralls 2,163,795 dated 6/27/39. The French patent is specifically designed to serve as a temporary storage means for game and is adapted to towing on the surface. Neither the French patent nor the U.S. counterpart patent is adapted to subsurface utility as a collapsible readily available adjunct to the diver's utility gear. Moreover, applicant's unique means of restraining the caddy and of securing the gear and/or equipment thereto is not shown or suggested in the art of record.

DESCRIPTION OF THE PREFERRED EMBODIMENTS

Figure 1:
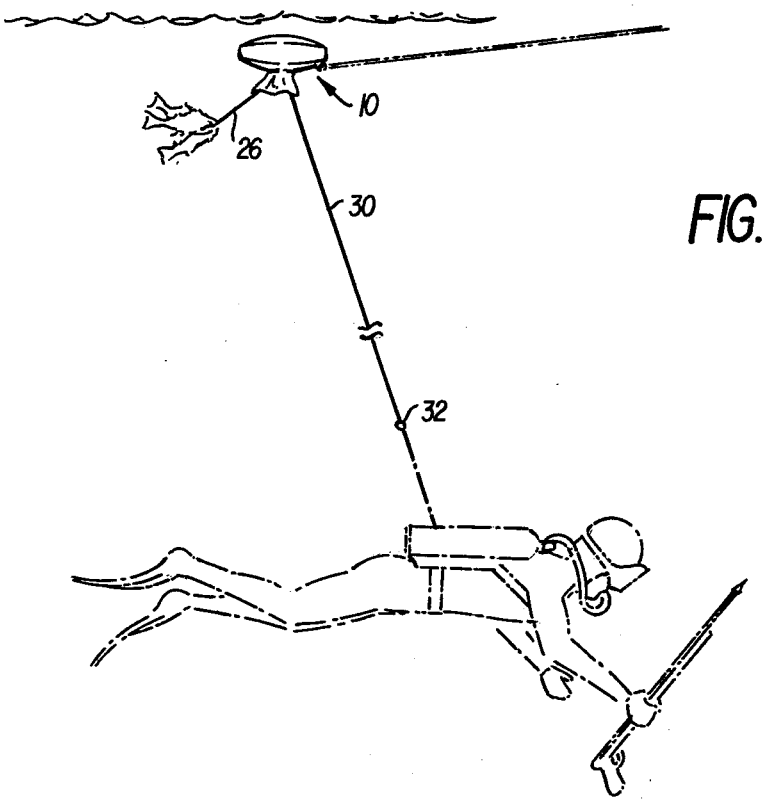
FIG. 1 is a side view of invention showing its adaptability to submarine usage.
Figure 2:
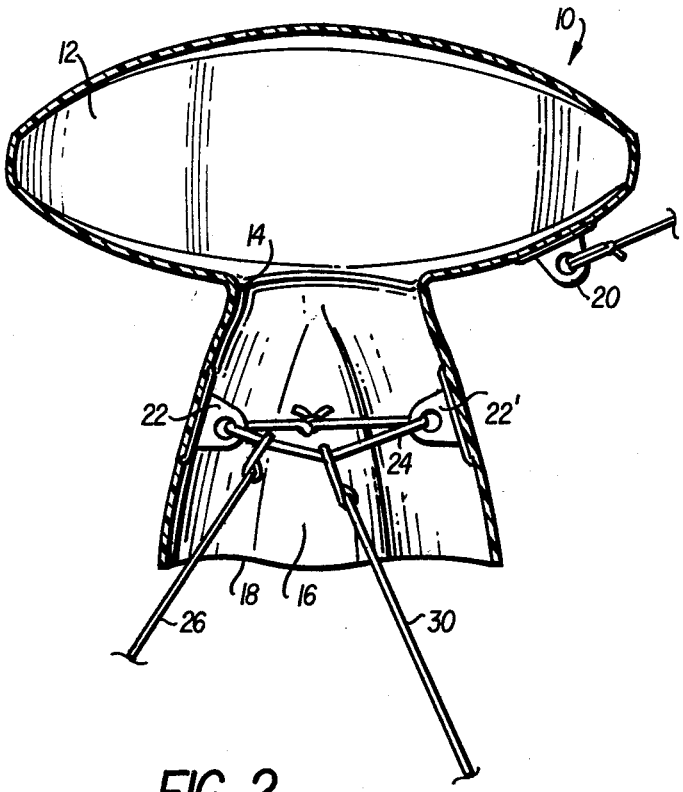
FIG. 2 is a vertical sectional view of invention taken along the lines 2—2 of FIG. 1.
Figure 3:
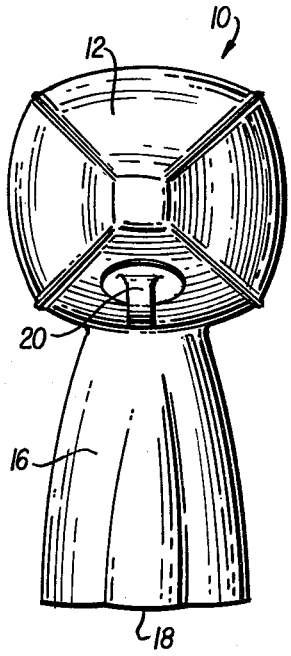
FIG. 3 is a front end elevational view of invention.

The main function of the device is to carry fish or other game away from the body of the diver to prevent a predator from attacking the diver should the predator attack the game. Alternately, the caddy serves as a suitable means to suspend anything the diver may want along during the course of his mission, be it nets, tools, or other gear useful in the performance of his mission.

With reference to the drawings, the caddy vessel 10 comprises an elongate enclosure 12 which is preferably made of a flexible bladder, the enclosure forming at its bottom an opening 14, said opening being surrounded by the semi-rigid skirt 16 which said skirt 16 has an enlarged opening 18. The enclosure 12 of the caddy vessel is provided at one end with a towline grommet 20.

Interioraly of the skirt 16 are plural grommets 22—22', said grommets providing a clevis for a flexible stringer 24. The purpose of the stringer 24 is to act as a suspension medium for the stringer extension 26 to which the game and/or gear may be detachably secured by suitable clamping means. As shown, both the extension 24 and restraint line 30 each slideably engage the stringer 24, each having a loop at the engaging end, thus being free to slide to the lowest point of line 24, if a grommet 22—22' should break loose. The restraint line 30 connects the caddy vessel to the diver while he is performing his mission. This is detachably secured to the stringer 24 during its submarine utility and may be shifted to the towline grommet 20 in the course of towing on a surface of the seaway.

As will be apparent, the caddy vessel when collapsed defines a substantially flat package which may be readily attached to the diver's belt. Upon diver requirement, it may be rendered buoyant by the scuba diver simply exhaling into the skirt, in sufficient quantity to offset the weight of the fish, shells, tools or other items which are to be hung from it by means of the stringer 24.

In operation, the suspense or restraint line 30 carries a marker 32 which may comprise a knot or tie to indicate a premeasured depth for decompression such as may be planned before the dive. In such instance, the diver would ascend until the caddy rides on the surface, holding the marker at chest level for accurate depth control. Whereas the caddy enclosure and skirt are preferably composed of a semi-rigid plastic material, various other materials may be employed and whereas the preferred vertical cross-section of the caddy enclosure is oblate and the horizontal section thereof biconvex, various related configurations may be adapted to the same objectives without departing from the spirit of invention as claimed hereinafter.

I claim:

1. A buoyant vessel which is adapted to a marine diver's use as a diver attachable caddy in the suspension, transport and storage of marine equipment, game and the like comprising:

A. a flexible bladder which is fluid impermeable, said bladder being elongated in a horizontal direction and streamlined longitudinally for facile movement under the water, primarily in horizontal directions, said bladder defining a skirt at its bottom which said skirt comprises a streamlined continuation of the bladder in a downward, vertical direction, said skirt forming inner and outer apertures at vertical ends thereof and defining an inflatable facemask connection between the bladder and the sea, whereby upon application of outer aperture to the face of the diver his exhalant may inflate the bladder;

B. a flexible stringer which is secured interiorly to the skirt and shielded thereby, said stringer providing a connection for a restraint line, joining the diver to the vessel, per se.

* * * * *